US006047748A

United States Patent [19]

Rooker

[11] Patent Number: 6,047,748

[45] Date of Patent: Apr. 11, 2000

[54] SANDBAG FILLING AIDING DEVICE

[76] Inventor: Donald J. Rooker, 18912 Wheeler Way, P.O. Box 703, Plymouth, Calif. 95669

[21] Appl. No.: 08/955,988

[22] Filed: Oct. 22, 1997

[51] Int. Cl.[7] ..... B65B 1/00

[52] U.S. Cl. ..... 141/391; 141/314; 141/316

[58] Field of Search ..... 141/391, 313, 141/314, 316; 248/97–101

[56] References Cited

U.S. PATENT DOCUMENTS

| | | | |
|---|---|---|---|
| 121,529 | 12/1871 | Lum | 141/391 |
| 130,489 | 8/1872 | Crofoot | 141/314 |
| 206,537 | 7/1878 | Cartier | 248/97 |
| 293,594 | 2/1884 | Purnell | 141/391 |
| 861,007 | 7/1907 | Wilhelm | 141/316 |
| 1,069,415 | 8/1913 | Grose | 141/314 |
| 1,253,948 | 1/1918 | Dugas | 248/101 |
| 1,254,371 | 1/1918 | Smith | 141/314 |
| 1,796,288 | 3/1931 | Hester | 141/314 |
| 2,087,711 | 6/1937 | Smith | 141/391 |
| 3,814,150 | 6/1974 | Gower | 141/391 |
| 5,048,778 | 9/1991 | Wright | 248/98 |
| 5,848,625 | 12/1998 | Ebert | 141/391 |

FOREIGN PATENT DOCUMENTS

| | | | |
|---|---|---|---|
| 1069669 | 7/1954 | France | 141/391 |

*Primary Examiner*—J. Casimer Jacyna

[57] ABSTRACT

A new sandbag filling aiding device for providing a means for quickly filling a sandbag with sand. The inventive device includes a funnel member with an inner surface defining a duct between its ends. On the outer surface of the funnel member is a hooking member for holding a portion of a bag placed over the bag filling end of the funnel member. The funnel member is mounted to the mounting portion of a support member that has three elongate legs downwardly and outwardly extending from the mounting portion.

1 Claim, 2 Drawing Sheets

SANDBAG FILLING AIDING DEVICE

BACKGROUND OF THE INVENTION

1. Field of the Invention

The present invention relates to sandbag filling devices and more particularly pertains to a new sandbag filling aiding device for providing a means for quickly filling a sandbag with sand.

2. Description of the Prior Art

The use of sandbag filling devices is known in the prior art. More specifically, sandbag filling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art sandbag filling devices include U.S. Pat. No. 5,397,085; U.S. Pat. No. 4,723,742; U.S. Pat. No. 4,485,855; U.S. Pat. No. Des. 304,872; U.S. Pat. No. 5,395,147; and U.S. Pat. No. 4,248,278.

While these devices fulfill their respective, particular objectives and requirements, the aforementioned patents do not disclose a new sandbag filling aiding device. The inventive device includes a funnel member with an inner surface defining a duct between its ends. On the outer surface of the funnel member is a hooking member for holding a portion of a bag placed over the bag filling end of the funnel member. The funnel member is mounted to the mounting portion of a support member that has three elongate legs downwardly and outwardly extending from the mounting portion.

In these respects, the sandbag filling aiding device according to the present invention substantially departs from the conventional concepts and designs of the prior art, and in so doing provides an apparatus primarily developed for the purpose of providing a means for quickly filling a sandbag with sand.

SUMMARY OF THE INVENTION

In view of the foregoing disadvantages inherent in the known types of sandbag filling devices now present in the prior art, the present invention provides a new sandbag filling aiding device construction wherein the same can be utilized for providing a means for quickly filling a sandbag with sand.

The general purpose of the present invention, which will be described subsequently in greater detail, is to provide a new sandbag filling aiding device apparatus and method which has many of the advantages of the sandbag filling devices mentioned heretofore and many novel features that result in a new sandbag filling aiding device which is not anticipated, rendered obvious, suggested, or even implied by any of the prior art sandbag filling devices, either alone or in any combination thereof.

To attain this, the present invention generally comprises a funnel member with an inner surface defining a duct between its ends. On the outer surface of the funnel member is a hooking member for holding a portion of a bag placed over the bag filling end of the funnel member. The funnel member is mounted to the mounting portion of a support member that has three elongate legs downwardly and outwardly extending from the mounting portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sandbag filling aiding device apparatus and method which has many of the advantages of the sandbag filling devices mentioned heretofore and many novel features that result in a new sandbag filling aiding device which is not anticipated, rendered obvious, suggested, or even implied by any of the prior art sandbag filling devices, either alone or in any combination thereof.

It is another object of the present invention to provide a new sandbag filling aiding device which may be easily and efficiently manufactured and marketed.

It is a further object of the present invention to provide a new sandbag filling aiding device which is of a durable and reliable construction.

An even further object of the present invention is to provide a new sandbag filling aiding device which is susceptible of a low cost of manufacture with regard to both materials and labor, and which accordingly is then susceptible of low prices of sale to the consuming public, thereby making such sandbag filling aiding device economically available to the buying public.

Still yet another object of the present invention is to provide a new sandbag filling aiding device which provides in the apparatuses and methods of the prior art some of the advantages thereof, while simultaneously overcoming some of the disadvantages normally associated therewith.

Still another object of the present invention is to provide a new sandbag filling aiding device for providing a means for quickly filling a sandbag with sand.

Yet another object of the present invention is to provide a new sandbag filling aiding device which includes a funnel member with an inner surface defining a duct between its ends. On the outer surface of the funnel member is a hooking member for holding a portion of a bag placed over the bag filling end of the funnel member. The funnel member is mounted to the mounting portion of a support member that has three elongate legs downwardly and outwardly extending from the mounting portion.

Still yet another object of the present invention is to provide a new sandbag filling aiding device that allows a user to quickly shovel sand into a sandbag rather than carefully pouring the sand into the sandbag.

Even still another object of the present invention is to provide a new sandbag filling aiding device that is collapsible and adjustable to allow for easy storage and easy adjustment of the height of the invention to suit a particular user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
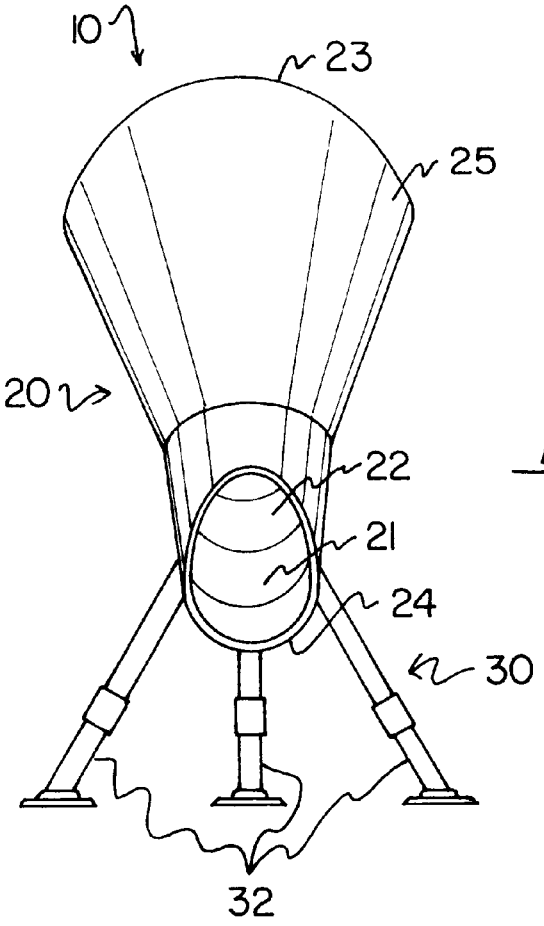
FIG. 1 is a front side perspective view of a new sandbag filling aiding device according to the present invention.
Figure 2:
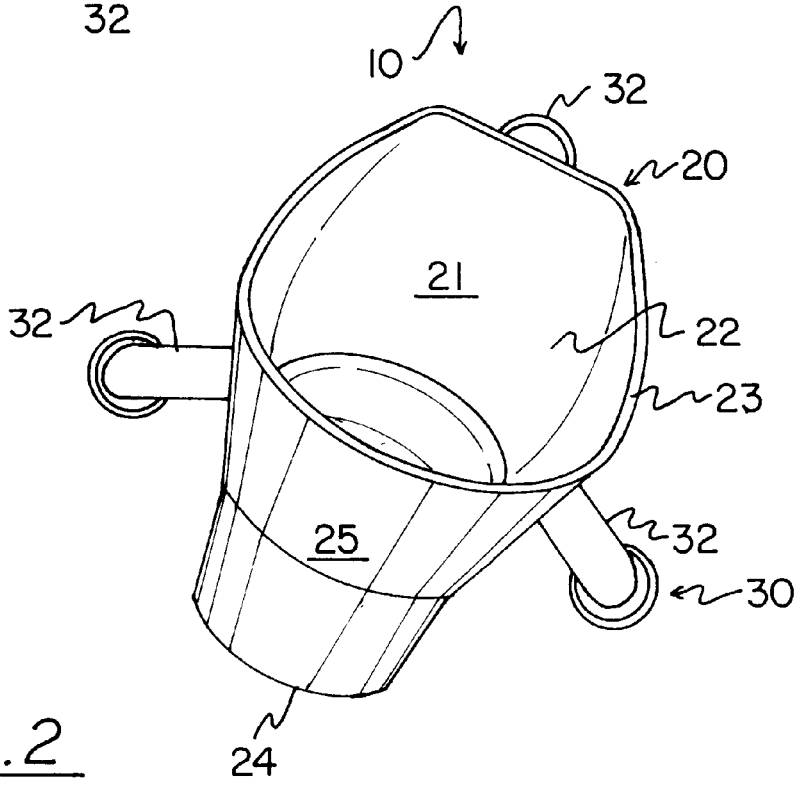
FIG. 2 is a top side perspective view of the present invention.

With reference now to the drawings, and in particular to FIGS. 1 through 4 thereof, a new sandbag filling aiding device embodying the principles and concepts of the present invention and generally designated by the reference numeral 10 will be described.

As best illustrated in FIGS. 1 through 4, the sandbag filling aiding device 10 generally comprises a funnel member 20 with an inner surface 21 defining a duct 22 between its ends 23,24. On the outer surface 25 of the funnel member 20 is a hooking member 26 for holding a portion of a bag placed over the bag filling end 24 of the funnel member. The funnel member 20 is mounted to the mounting portion 31 of a support member 30 that has three elongate legs 32 downwardly and outwardly extending from the mounting portion 31.

Figure 3:
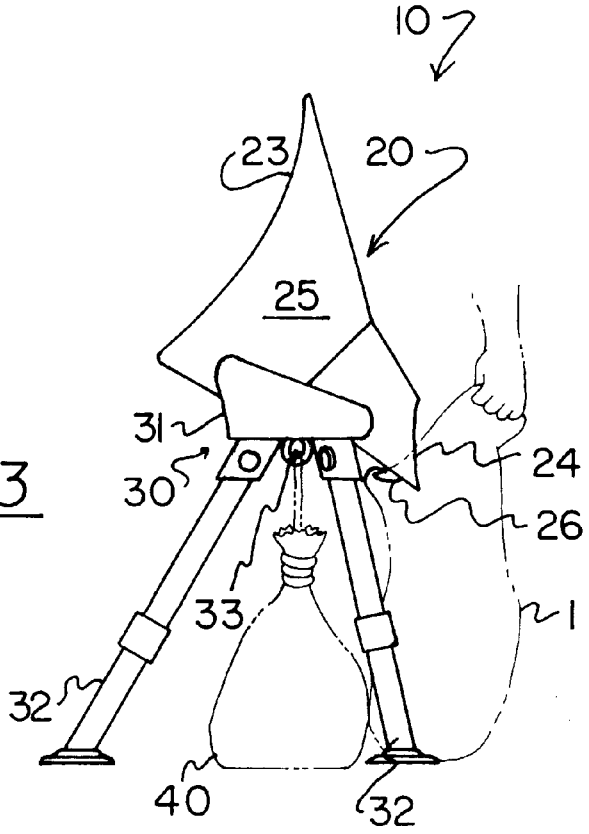
FIG. 3 is a side view of the present invention in use with an attached stabilizing ballast member depending from the mounting portion of the support member.
Figure 4:
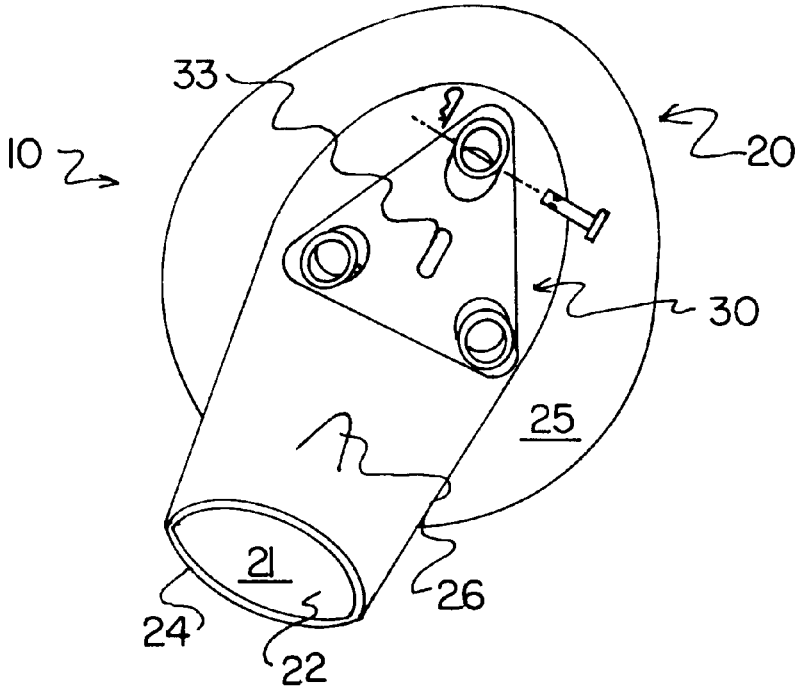
FIG. 4 is a bottom side perspective view of the present invention with the legs of the support member detached from the support member.

The ballast receiving end 23 is designed for receiving ballast material, such as sand, into the funnel member duct 22. Preferably, the funnel member 20 is flared at its a ballast receiving end 23 so that sand can be quickly thrown in rather than carefully poured into the funnel member 20. The funnel member is tapered from its ballast receiving end 23 to its bag filling end 24 which is designed for positioning the opening of a bag 1 around it to permit filling of the bag 1 with ballast material, as shown in FIG. 3. Also shown in FIG. 3 is the hooking member 26 which is extended from the outer surface 25 of the funnel member 20 and positioned towards the bag filling end 24.

The funnel member 20 is mounted to the mounting portion 31 of the support member 30. Preferably, the three legs 32 of the support member 30 are detachably coupled to the mounting portion 31 for easy disassembly of the invention 10. The legs 32 are downwardly and outwardly extended from the mounting portion 31 so that a bag 1 attached to the bag filling end 24 may be positioned between two of the legs 32. Also preferably, the legs 32 are adjustably extendable to permit variable positioning of the funnel member 20 in relation to a ground surface.

In the preferred embodiment, the sandbag filling aiding device 10 also includes a stabilizing ballast member 40, such as a filled sandbag. The stabilizing ballast member 40 is depended from the mounting portion 31 and helps hold the funnel member 20 in position when ballast material is passed through the duct 22 of the funnel member 20. Ideally, the stabilizing ballast member 40 is attached to a loop member 33 extending from the mounting portion 31 of the support member.

In use, a portion of a sandbag is hooked on the hooking member 26 and the bag is held over the bag filling end 24 of the funnel member by a user, as shown in FIG. 3. A second user may then insert ballast material, such as sand, into the duct 22 through the ballast receiving end 23 of the funnel member 20 to fill the held sandbag. The flared ballast receiving end 23 allows the second user may throw sand into the duct 22 rather than carefully pouring sand into the sandbag to be filled thereby reducing the time need to fill the sandbag.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag filling device, comprising:

a funnel member having an inner surface, an outer surface, a ballast receiving end, and a bag filling end;

said inner surface of said funnel member defining a duct between said ballast receiving end and said bag filling end, said ballast receiving end being for receiving ballast material into said funnel member duct, said bag filling end being for positioning the opening of a bag therearound to permit filling of the bag with ballast material;

said funnel member being tapered from said ballast receiving end towards said bag filling end;

a hooking member being extended from said outer surface of said funnel member, said hooking member being positioned towards said bag filling end, said hooking member being for holding a portion of a bag thereon;

a support member having a mounting portion and three elongate legs, said mounting portion having a loop member for hanging a stabilizing ballast member therefrom, said funnel member being mounted on said mounting portion of said support member, said legs being detachably coupled to said mounting portion, said legs being downwardly and outwardly extended from said mounting portion, said legs being adjustably extendable for permitting variable positioning of said funnel member in relation to a ground surface; and a stabilizing ballast member being depended from said loop member of said mounting portion, said stabilizing ballast member being for helping hold said funnel member in position when ballast material is passed through said duct of said funnel member.

* * * * *